United States Patent [19]

Romeo et al.

[11] Patent Number: 4,761,850

[45] Date of Patent: Aug. 9, 1988

[54] VACUUM CLEANER HAVING AN INTEGRAL TOOL HOLDER

[75] Inventors: Robert Romeo, Maplewood, N.J.; Robert A. Chieda, Westport, Conn.

[73] Assignee: The Regina Co., Inc., Rahway, N.J.

[21] Appl. No.: 121,498

[22] Filed: Nov. 16, 1987

[51] Int. Cl.[4] ..... A47L 9/00

[52] U.S. Cl. ..... 15/323

[58] Field of Search ..... 15/323

[56] References Cited

U.S. PATENT DOCUMENTS

| | | | |
|---|---|---|---|
| 2,854,686 | 10/1958 | Hansen | 15/323 X |
| 3,253,294 | 5/1966 | Waters | 15/323 |
| 3,619,850 | 11/1971 | Rideout et al. | 15/323 |
| 3,778,863 | 12/1973 | Westergren et al. | 15/323 |
| 4,554,700 | 11/1985 | Lyman | 15/323 |
| 4,642,840 | 2/1987 | Jacob et al. | 15/323 |
| 4,715,803 | 12/1987 | Harris et al. | 15/323 |

FOREIGN PATENT DOCUMENTS

| | | |
|---|---|---|
| 2425227 | of 1979 | France . |
| 562056 | of 1957 | Italy . |

*Primary Examiner*—Chris K. Moore
*Attorney, Agent, or Firm*—Martin LuKacher

[57] ABSTRACT

An upright vacuum cleaner which is convertible for floor cleaning and above the floor cleaning, has a housing mounted on a floor nozzle in which a vacuum is drawn. A hose extending from the housing is insertable into a conduit which leads into the floor nozzle for floor cleaning. The hose also receives tools for above the floor cleaning. These tools are removably held in a tool holder on the rear wall of the housing with recesses and lands in the wall which is flexible. The recess at one end of the wall is defined by a member which overlaps the wall to define a lip. A nozzle for above the floor cleaning snaps over the lip and is held in the compartment between the wall and the end of a land between the recesses with the mouth of the nozzle behind the lip and the open end of the nozzle opposite its mouth on a rib on the end of that land which catches the open end of the nozzle.

The flexible wall can readily be depressed so as to release the nozzle when it is to be used.

6 Claims, 4 Drawing Sheets

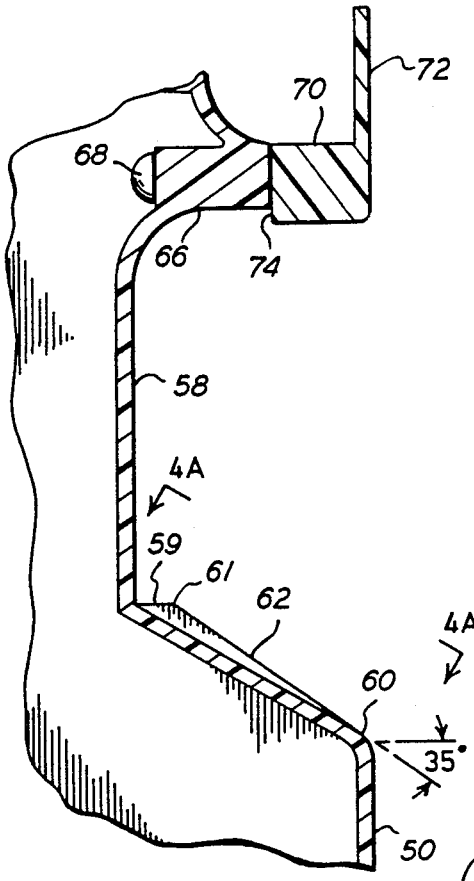
FIG. 4
FIG. 4A
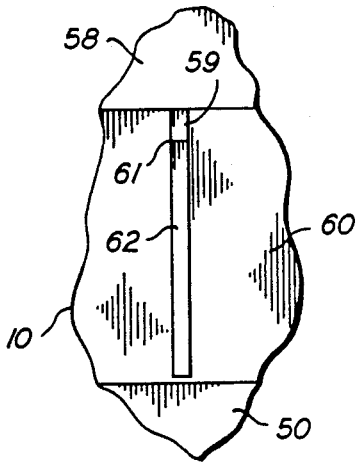
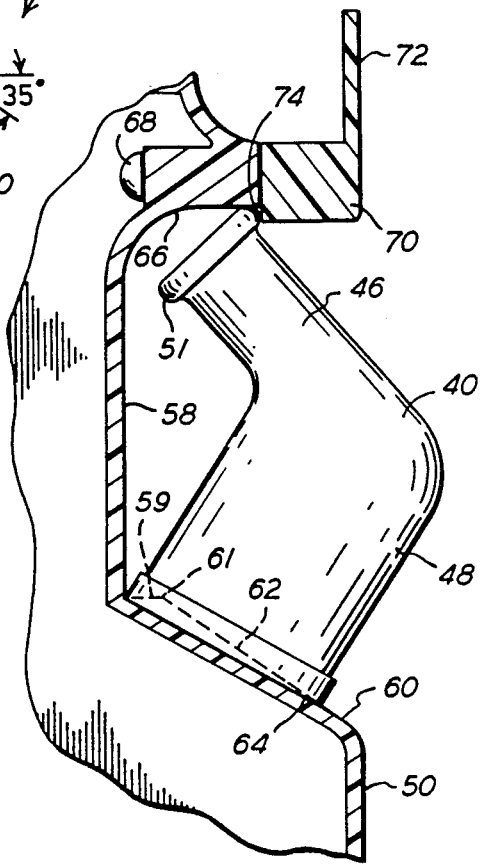
FIG. 5

VACUUM CLEANER HAVING AN INTEGRAL TOOL HOLDER

DESCRIPTION

The present invention relates to vacuum cleaners, and particularly to a vacuum cleaner having a housing with a tool holder integrally formed in the housing.

The invention is especially suitable for use in convertible vacuum cleaners which have floor nozzles into which a hose extends from a housing; the tool holder removably receiving tools for above the floor cleaning which can be connected to the hose.

Vacuum cleaner tools or attachments are usually stored in a box separate from the vacuum cleaner and are often lost or misplaced. It has been proposed to attach racks for holding tools to the vacuum cleaner (see Hansen, U.S. Pat. No. 2,854,686 issued Oct. 7, 1958). Sometimes clips have been used for tools (see Italian Pat., No. 562,056 of May 4, 1957). It has also been suggested to place recesses for hoses in the housing of a canister vacuum cleaner (see French patent publication No. 2,425,227 published July 12, 1979). However, there has not heretofore been available a vacuum cleaner tool holder capable of holding on, and particularly in, the housing of the vacuum cleaner, a large variety of tools, including nozzles which can readily be snapped in and out of the holder. These tools are securely held when not in use and are removable with force which can readily be exerted with one hand by the user. A vacuum cleaner having an integral tool holder can be of such an ornamental design as is pleasing and attractive. Such ornamental design features are the subject of our co-pending design application, Ser. No. 07/051,113 filed in the U.S. Patent and Trademark Office on May 15, 1987.

It is the principal object of the present invention to provide, in a vacuum cleaner, an improved tool holder which is integral with the housing of the vacuum cleaner and can readily store a plurality of tools, including nozzles, which can also readily be removed from storage.

It is a still further object of the present invention to provide an improved tool holder which can be of molded construction and an integral part of the housing of the vacuum cleaner and yet enables tools, particularly a nozzle, to be inserted and removed by snap-in and snap-out action.

It is a still further object of the present invention to provide an improved tool holder for use in a vacuum cleaner which is adapted to be incorporated in the vacuum cleaner in a design which can be ornamental and attractive, for holding a variety of tools, including a nozzle, in a manner which facilitates their placement in and removal from the tool holder.

Briefly described, an improved tool holder, in accordance with the invention, for a vacuum cleaner is capable of holding a plurality of vacuum cleaner tools, including wands and a nozzle. The tool holder is an integral part of the housing of the vacuum cleaner and is formed in an flexible wall of the housing of the vacuum cleaner by recesses defining lands and depressions between the lands. The depressions define compartments for releasably retaining the tools. One of the compartments has a wall extending from one of the lands. This compartment also has a second wall opposite to the first mentioned wall. The second wall has an edge. A member is attached to the housing and disposed along the edge in overlapping relationship with the edge to define a lip over which a nozzle can snap into place in a retained position between the first and second walls. The other compartments may extend along the sides of the housing below the nozzle retaining housing and can receive the wands and other cleaning tools. The lands and depressions can be molded, as by injection molding, of flexible material which constitutes the housing walls.

The foregoing and other objects, features and advantages of the invention as well as a presently preferred embodiment thereof will become more apparent from a reading of the following description in connection with the accompanying drawings in which:

FIG. 4 is a fragmentary sectional view along a vertical plane through the center of the nozzle receiving compartment of the tool holder with the nozzle removed;

FIG. 4A is a fragmentary view taken along the lines 4A—4A in FIG. 4; and FIG. 5 is a view similar to FIG. 4 with the nozzle in place.

Figure 1:
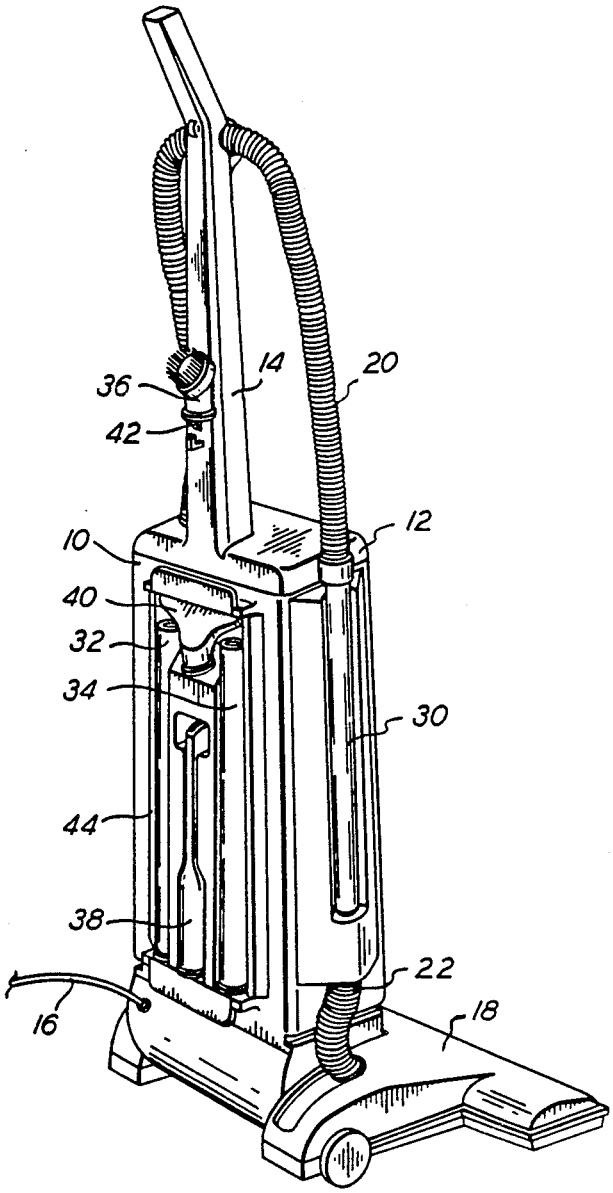
FIG. 1 is a perspective view of a vacuum cleaner in which a tool holder in accordance with the invention is embodied, the view being from the rear of the vacuum cleaner.
Figure 2:
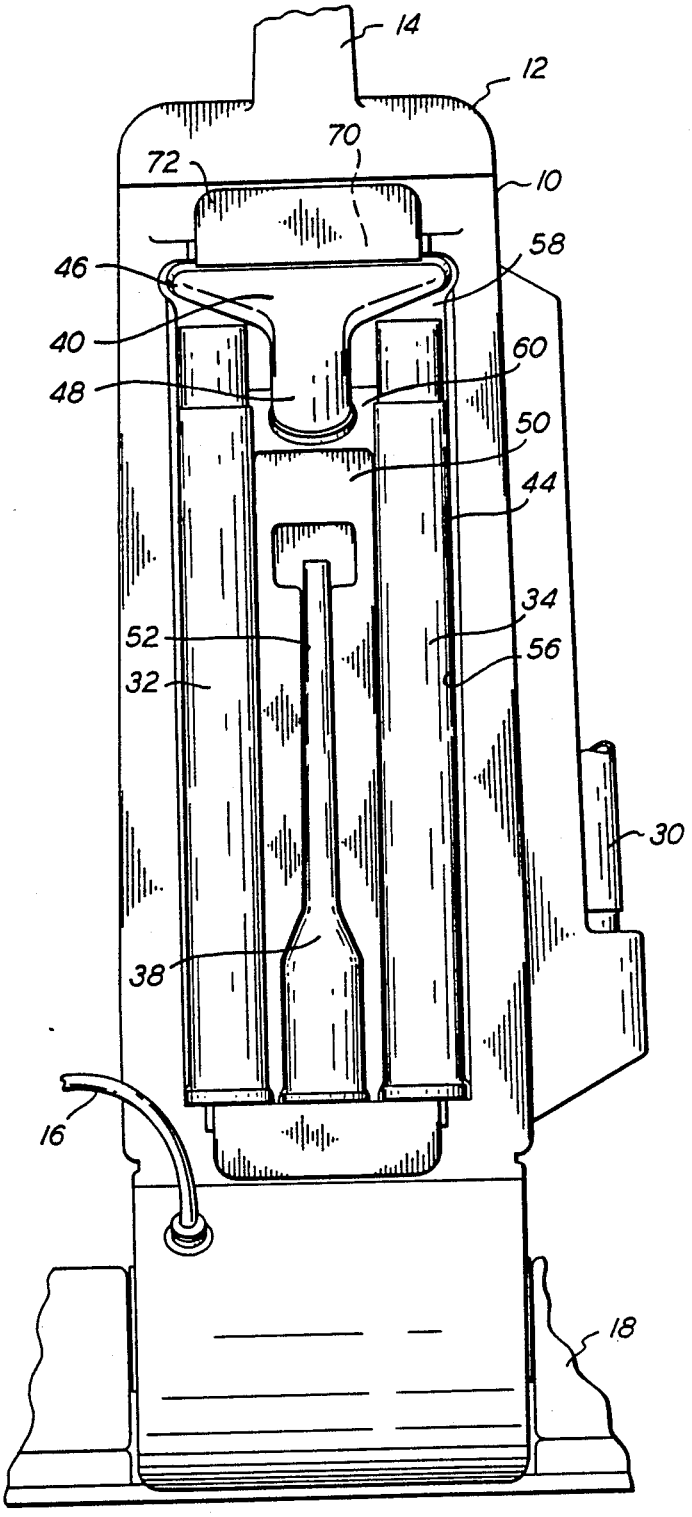
FIG. 2 is a fragmentary elevational view of the vacuum cleaner shown in FIG. 1 taken from the rear.
Figure 3:
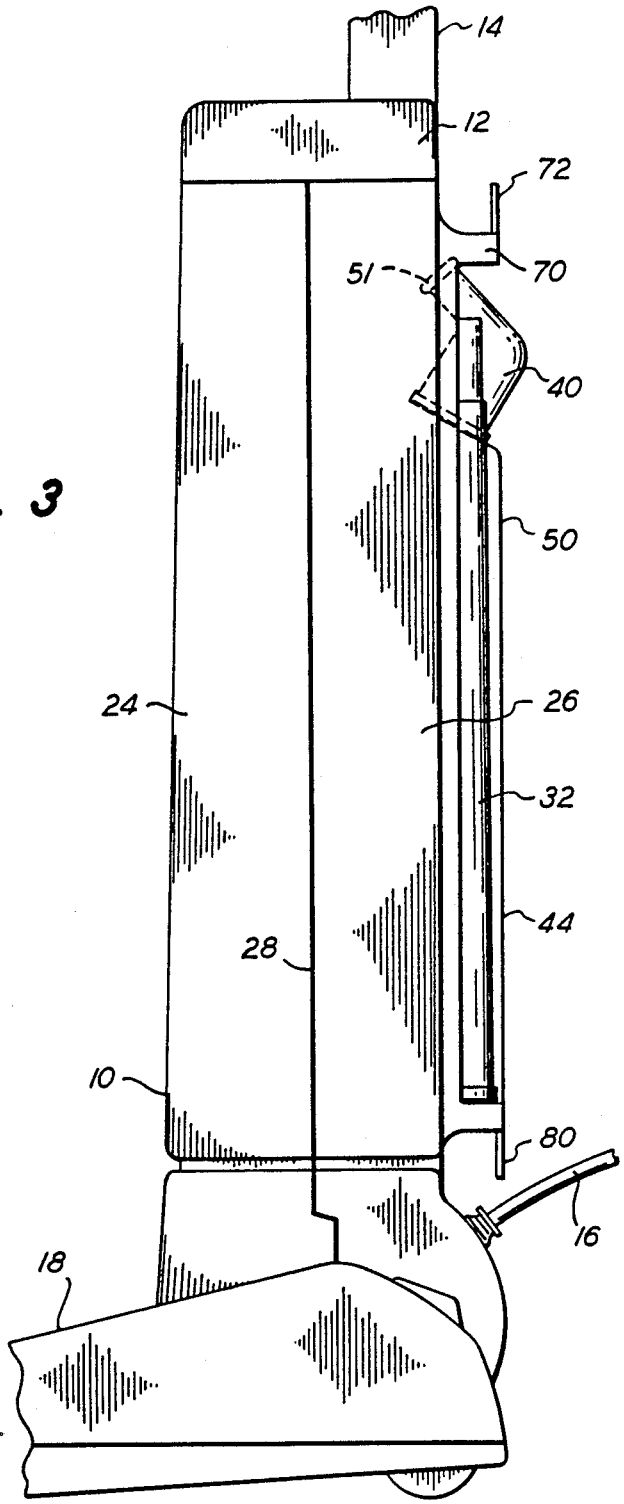
FIG. 3 is a fragmentary elevational side view of the vacuum cleaner shown in FIGS. 1 and 2.

Referring to the drawings, there is shown a convertible upright vacuum cleaner having a housing 10 in which a vacuum is drawn by a motor which is disposed in the housing. A cover 12 with a handle 14 are attached to the housing. The handle 14 and cover are hinged on the housing. By opening the cover which is held closed by a latch, a dust collection bag is exposed for replacement. The electrical power is provided a line cord 16 which goes to the motor in the housing. The housing is pivotally mounted on a floor nozzle 18. The vacuum drawn in the housing is communicated by way of a hose 20 which may be inserted into another hose 22 which extends upwardly from the floor nozzle 18. The housing may be made in two parts, namely a front part 24 and a rear part 26 which are assembled together along a parting line 28 (see FIG. 3). The hose 20 may be captured in a circular notch 21 in the handle 14 which restrains the hose during the floor cleaning mode of operation.

For above the floor cleaning, the hose with a wand 30 at the end thereof may be connected to tools. The complement of tools may include extension wands 32 and 34, a brush 36, a crevice tool 38 and a nozzle 40. The brush is mounted on a hook 42 on the handle. The other tools are removably received in a tool holder 44.

The nozzle has a mouth 46 and a tubular neck 48. A rim 50 extends around the edge of the opening to the mouth. The nozzle may be assembled on the end of the wand 30 or the extension wands 32 and 34. Similarly, the crevice tool 38 or the brush 36 may be placed on the end of the wand or the extension wands. The axis of the neck 48 of the nozzle 40 defines an angle of less than 180° and approximately equal to 90° between the axis of the mouth 46 of the nozzle so as to conveniently place the opening of the mouth against the surface being cleaned when the wand is essentially vertical.

The housing has a flexible rear wall which is injection molded of plastic to form the tool holder 44. The molding defines a land 50 centrally of and paralleling the sides of the housing. This land has a recess 52 in the center thereof which recess 52 also parallels the sides of the housing. The recess receives the crevice tool. The sides of the recess may be approximately equal to the width of the crevice tool so as to hold it with a friction fit.

Also paralleling the sides of the housing, and of generally circular shape in cross-section, are recesses 54 and 56 for receiving the extension wands 32 and 34. Since the material of the wall is flexible, the wands can be pushed into the recesses so that the sides of the recesses flex apart. When the wands are inserted, the sides relax and hold the wands in place.

Another recess 58 which extends across the upper end of the tool holder adjacent the upper end of the housing 10 defines a compartment for the nozzle 40. This recess 58 is also defined by an upper end surface 60 of the land 50. This surface 60 is disposed at an angle again less than 180° and has a rib 62. The surface 60 is at an acute angle, suitably 30° to the horizontal (a plane perpendicular to the line 28 of separation). The rib 62 is at a slightly greater acute angle, e.g. 35°. The forward end 59 of the rib is approximately horizontal and form a catch at 61 for the ring formed by the nozzle face 64. The open end of the neck section 48 of the nozzle 40 presents a face 64 which is in the form of a circular ring which bears upon the wall 60 of the land 50. The rib 62 enters the neck and locates the nozzle 40 in the nozzle compartment 58. The upper wall 66 of the nozzle compartment also defines the upper wall of the tool holder 44 and extends across the compartments which hold the wands 32 and 34. Attached to the wall 66, as by screws 68, is a member 70 in the form of a bar having a projecting plate 72. The bar portion of the member 70 is wider than the wall 66 and overlaps the wall inwardly of the compartment 58 to form a lip 74.

The rim 51 of the nozzle 40 snaps over this lip 74, since the wall is flexible and can be depressed. In other words, the nozzle detents over the lip and is held securely in place, but can readily be removed merely by a twisting and pull-out motion.

Another projecting member 80 is disposed at the lower end of the tool housing and extends in a direction opposite to the plate 72. The line cord 16 can be wound around the housing and is captured by these projections 72 and 80.

From the foregoing description it will be apparent that there has been provided an improved tool holder which is integral with the housing of a vacuum cleaner which can retain a plurality of tools including a nozzle. Variations and modifications of the herein-described tool holder and its ancillary parts, within the scope of the invention, will undoubtedly suggest themselves to those skilled in the art. Accordingly, the foregoing description should be taken as illustrative and not in a limiting sense.

We claim:

1. In a vacuum cleaner having a housing, a tool holder for a plurality of vacuum cleaner tools, including wands and a nozzle, said holder comprising a flexible wall of said housing having recesses defining lands and depressions between said lands, said depressions defining compartments for releasably retaining said tools, one of said compartments having a first wall extending therein from one of said lands, said one compartment also having a second wall opposite to said first wall and having an edge, a member attached to said housing and disposed along said edge in overlapping relationship with said edge to define a lip over which said nozzle can snap into retained position between said first and second walls.

2. The invention according to claim 1 wherein said nozzle has a mouth section extending to a tubular neck section, said tubular neck section having an axis, said mouth section and said neck section defining an angle of less than 180° therebetween, said neck having an end face perpendicular to the axis of said neck section, said second wall being disposed at such an angle with respect to said first wall that said end face is in juxtaposition with said second wall when said nozzle is in said retained position.

3. The invention according to claim 2 further comprising a rib on said first wall, said rib presenting a catch for said tubular neck, and which rib is disposed within said neck when said end face is on said second wall.

4. The invention according to claim 2 wherein said housing is oblong in shape and has ends and sides, said second wall being disposed adjacent to one of said ends, one of said lands extending in a direction between said ends, a pair of said recesses extending along said sides between different ones of said sides and said one land to define compartments for tubular wands, said first wall being at one end of said land, said second wall extending to cross both of said wand compartments and defining with the ends of said wand compartments and said first wall the compartment for said nozzle, which nozzle compartment extends across said wand compartments.

5. The invention according to claim 4 further comprising a recess in said one land generally paralleling said sides for a generally tubular one of said plurality of said tools.

6. The invention according to claim 4 further comprising a second member attached to said wall generally paralleling said member along said second wall, said second member being disposed at the opposite end of said tool holder, both of said members having projections spaced from said wall and extending in opposite directions to define a support around which an electrical line cord is wrappable.

* * * * *